US008663074B2

(12) United States Patent
Uygan

(10) Patent No.: US 8,663,074 B2
(45) **Date of Patent: *Mar. 4, 2014**

(54) EXERCISE APPARATUS WITH A PULL CORD CENTRAL PULLEY ATTACHED TO A CARRIAGE AND A PULLEY LOCKING MECHANISM

(75) Inventor: Viktor Uygan, Mission Viejo, CA (US)

(73) Assignee: Balanced Body, Inc., Sacramento, CA (US)

( * ) Notice: Subject to any disclaimer, the term of this patent is extended or adjusted under 35 U.S.C. 154(b) by 757 days.

This patent is subject to a terminal disclaimer.

(21) Appl. No.: 12/719,396

(22) Filed: Mar. 8, 2010

(65) Prior Publication Data

US 2011/0218081 A1 Sep. 8, 2011

Related U.S. Application Data

(63) Continuation of application No. 11/983,143, filed on Nov. 7, 2007, now Pat. No. 7,674,211.

(51) Int. Cl.
*A63B 21/00* (2006.01)

(52) U.S. Cl.
USPC ..... 482/95; 482/96; 482/142; 482/130; 482/123

(58) Field of Classification Search
USPC ..... 482/96, 95, 142, 130, 123
See application file for complete search history.

(56) References Cited

U.S. PATENT DOCUMENTS 1,621,477 A 3/1927 Pilates
1,785,876 A 12/1930 Pilates
1,874,613 A 8/1932 Pilates
1,876,743 A 9/1932 Pilates
1,969,901 A 8/1934 Pilates
2,132,862 A 10/1938 Pilates
2,570,855 A 10/1951 Pilates
3,620,530 A 11/1971 Cosby
4,004,801 A 1/1977 Campanaro et al.
4,101,124 A 7/1978 Mahnke
4,911,438 A * 3/1990 Van Straaten ..... 482/96
5,354,251 A 10/1994 Sleamaker
5,681,249 A 10/1997 Endelman
5,792,033 A 8/1998 Merrithew
5,906,564 A 5/1999 Jacobsen
5,938,571 A 8/1999 Stevens
6,338,704 B1 * 1/2002 Endelman ..... 482/142
6,371,895 B1 4/2002 Endelman et al.
6,634,997 B2 10/2003 Breibart et al.
6,669,609 B2 12/2003 Gerschefske et al.
6,692,412 B2 2/2004 Chen et al.
6,837,838 B2 1/2005 List
6,916,279 B2 7/2005 Endelman (Continued)

*Primary Examiner* — Jerome w Donnelly
(74) *Attorney, Agent, or Firm* — Greenberg Travrig, LLP

(57) ABSTRACT

An exercise apparatus including a frame, a carriage, a central pulley, first and second frame pulleys, a pull cord, and a locking mechanism. The frame defines a longitudinal axis. The carriage is mounted on the frame and movable along the longitudinal axis. The central pulley is attached to the carriage. The first and second frame pulleys are attached to the frame. The pull cord has first and second handle portions. The pull cord is looped about the pulleys. The central pulley is between the first and second frame pulleys along the pull cord. The first frame pulley is between the first handle portion and the central pulley along the pull cord. The second frame pulley is between the second handle portion and the central pulley along the pull cord. The locking mechanism is configured to engage the central pulley.

19 Claims, 6 Drawing Sheets

(56) References Cited

U.S. PATENT DOCUMENTS

| | | | | |
|---|---|---|---|---|
| 6,921,355 | B2 * | 7/2005 | Campanaro et al. | 482/95 |
| 6,926,650 | B2 | 8/2005 | Endelman et al. | |
| 7,104,937 | B2 | 9/2006 | Arbuckle et al. | |
| 7,125,369 | B2 | 10/2006 | Endelman | |
| 7,163,498 | B1 | 1/2007 | Abelbeck | |
| 7,163,500 | B2 | 1/2007 | Endelman et al. | |
| 7,179,207 | B2 | 2/2007 | Gerschefske | |
| 2008/0171643 | A1 | 7/2008 | Baudhuin | |

* cited by examiner

EXERCISE APPARATUS WITH A PULL CORD CENTRAL PULLEY ATTACHED TO A CARRIAGE AND A PULLEY LOCKING MECHANISM

CROSS-REFERENCE TO RELATED APPLICATIONS

The present application is a continuation patent application which claims the benefit of U.S. patent application Ser. No. 11/983,143, filed on Nov. 7, 2007, now U.S. Pat. No. 7,674,211, the entire contents of which are incorporated herein by reference.

STATEMENT RE: FEDERALLY SPONSORED RESEARCH/DEVELOPMENT (Not Applicable)

BACKGROUND

The present invention relates generally to exercise equipment and, more particularly, to an exercise apparatus with a pull cord central pulley attached to a carriage and a pulley locking mechanism.

The so-called "Pilates" method is a popular form of physical fitness training worldwide. The Pilates method uses a multitude of different exercises designed to increase flexibility, strength, and coordination. A popular exercise apparatus associated with the Pilates method is the "reformer" type apparatus. The reformer type apparatus is basically a resistance exercise apparatus. It consists of a wheeled carriage that is mounted to a rectangular frame. The carriage rides upon frame side rails of the frame translating back and forth along a frame longitudinal axis. Resistance is provided by the exerciser's body weight and/or by resistance members, such as springs.

The carriage consists of a top side where the exerciser puts his or her body. The carriage includes a top side upon which a pair of shoulder pads and a head pad in between the shoulder pad are disposed. The frame includes a head end and an opposing foot end. The shoulder pads and head pad are disposed adjacent the head end of the frame. The resistance members are attached to the frame and the carriage at the foot end of the frame. A foot rest may be attached to frame at the foot end.

The reformer type apparatus further includes a pair of pull cords. At the head end the frame further includes vertical pulley supports each with a frame pulley. Each of the pull cords are attached to the carriage. The pull cords each respectively extend to and loop about the frame pulleys and terminate at first and second handle portions of the pull cords. When performing exercises the exerciser grasps each of the first and second handle portions.

An exerciser uses the apparatus by laying, sitting or otherwise being supported by the carriage. Many basic reformer exercises are done lying down with the exerciser's head on the head pad with the shoulder pads providing stability to the exerciser. The exerciser's feet may be supported by the foot rest. The carriage is moved along the longitudinal axis by pulling the first or second handle portions and/or by pushing against the foot rest while responding to the effort that the exerciser exerts and the amount of resistance set up by the resistance members. There are also exercises where the exerciser is turned around and places the feet through the first or second handle portions.

There exists a need in the art for an improved reformer type apparatus that facilitates a versatility of the types of exercises that an exerciser may perform using the apparatus in comparison to the prior art.

BRIEF SUMMARY

According to an aspect of the present invention, there is provided an exercise apparatus. The exercise apparatus includes a frame, a carriage, a central pulley, a first frame pulley, a second frame pulley, a pull cord, and a central pulley locking mechanism. The frame has a frame head end and an opposing frame foot end. The frame defines a frame longitudinal axis. The carriage is mounted on the frame and movable along the frame longitudinal axis. The first frame pulley is attached to the frame adjacent the frame head end. The second frame pulley is attached to the frame adjacent the frame head end. The pull cord has first and second handle portions. The pull cord is looped about the central pulley, the first frame pulley and the second frame pulley. The central pulley is between the first and second frame pulleys along the pull cord. The first frame pulley is between the first handle portion and the central pulley along the pull cord, the second frame pulley being between the second handle portion and the central pulley along the pull cord. The central pulley locking mechanism is attached to the carriage and configured to engage the central pulley for mitigating movement of the pull cord along the central pulley.

According to various embodiments, the central pulley locking mechanism includes a locking bar. The locking bar has a locked position with the locking bar engaged with the central pulley, and the locking bar has an unlocked position with the locking bar not engaged with the central pulley. The central pulley may include a central pulley wheel and the locking bar tangentially engages the central pulley wheel. The central pulley may includes a central pulley wheel with the pull cord being looped about the central pulley wheel, and the central pulley locking mechanism being configured to mitigate rotation of the central pulley wheel.

In addition, the frame may further include first and second pulley supports extending from the frame. The first frame pulley is attached to the first pulley support, and the second frame pulley is attached to the second pulley support. The carriage may include a top side and an opposing bottom side. The top side is disposed generally facing away from the frame. The bottom side is disposed generally facing towards the frame, and the central pulley is attached to the carriage at the bottom side. The carriage may define a carriage longitudinal axis parallel to the frame longitudinal axis, and the central pulley may be attached to the carriage adjustably along the carriage longitudinal axis. The central pulley may include a pulley pin and a pulley wheel disposed about the pulley pin. The pull cord is looped about the pulley wheel, and the pulley pin may be attached to the carriage adjustably along the carriage longitudinal axis. The exercise apparatus may further includes a gear engaged with the central pulley. Rotation of the gear translates the central pulley along the carriage longitudinal axis.

Further, the carriage may define a carriage longitudinal axis parallel to the frame longitudinal axis. The exercise apparatus may further comprise first and second lateral central pulleys laterally disposed about the central pulley with respect to the carriage longitudinal axis. The pull cord may be looped about the first and second lateral central pulleys. The central pulley may be between the first and second lateral central pulleys along the pull cord. The first lateral central pulley may be between the first frame pulley and the central pulley along the pull cord. The second lateral central pulley may be between the second frame pulley and the central pulley along the pull cord. The exercise apparatus may further comprise first and second guide wheels attached to the carriage. The pull cord may be tangentially engaged with the first guide wheel with the first guide wheel being between the central pulley and the first frame pulley. The pull cord may be tangentially engaged with the second guide wheel with the second guide wheel being between the central pulley and the second frame pulley. The frame may define a frame horizontal plane that includes the frame longitudinal axis. The first and second frame pulleys may be disposed along an axis parallel to the frame horizontal plane. The exercise apparatus may further include a resistance member attached to the carriage foot end. The resistance member may be configured to resist movement of the carriage along the frame longitudinal axis in a direction away from the frame foot end.

According to another aspect of the present invention, there is provided a retrofit kit for use with an exercise apparatus may be as described above. The retrofit kit includes a pulley housing that is attachable to the carriage. A central pulley is provided that is attached to the pulley housing. Further, a pull cord is provided that may be used to replace a pair existing pull cords provided with a conventional reformer type apparatus.

BRIEF DESCRIPTION OF THE DRAWINGS

These and other features and advantages of the various embodiments disclosed herein will be better understood with respect to the following description and drawings in which like numbers refer to like parts throughout and in which.

DETAILED DESCRIPTION

Figure 1:
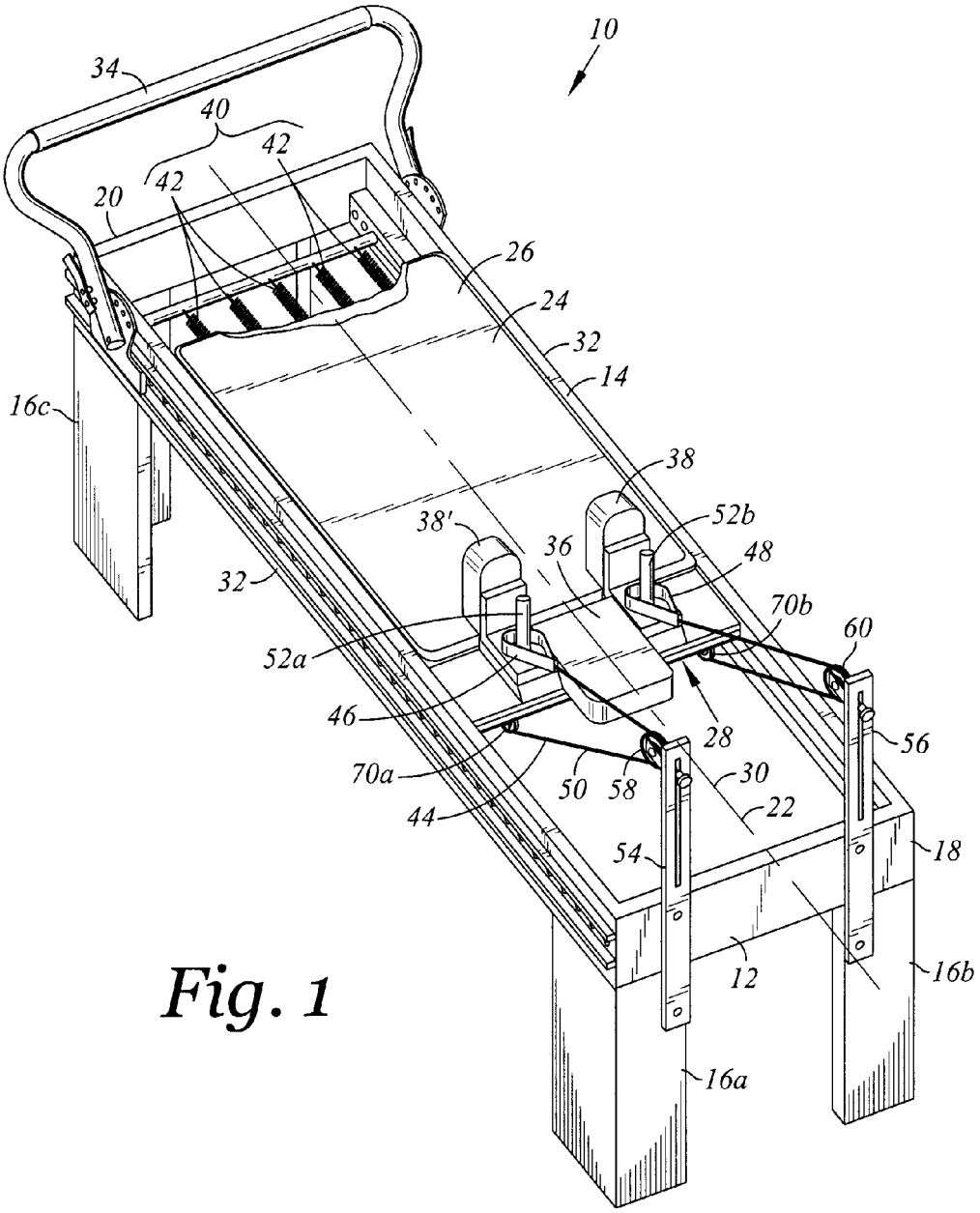
FIG. 1 is a perspective top view of an exercise apparatus in accordance with an aspect of the present invention.
Figure 2:
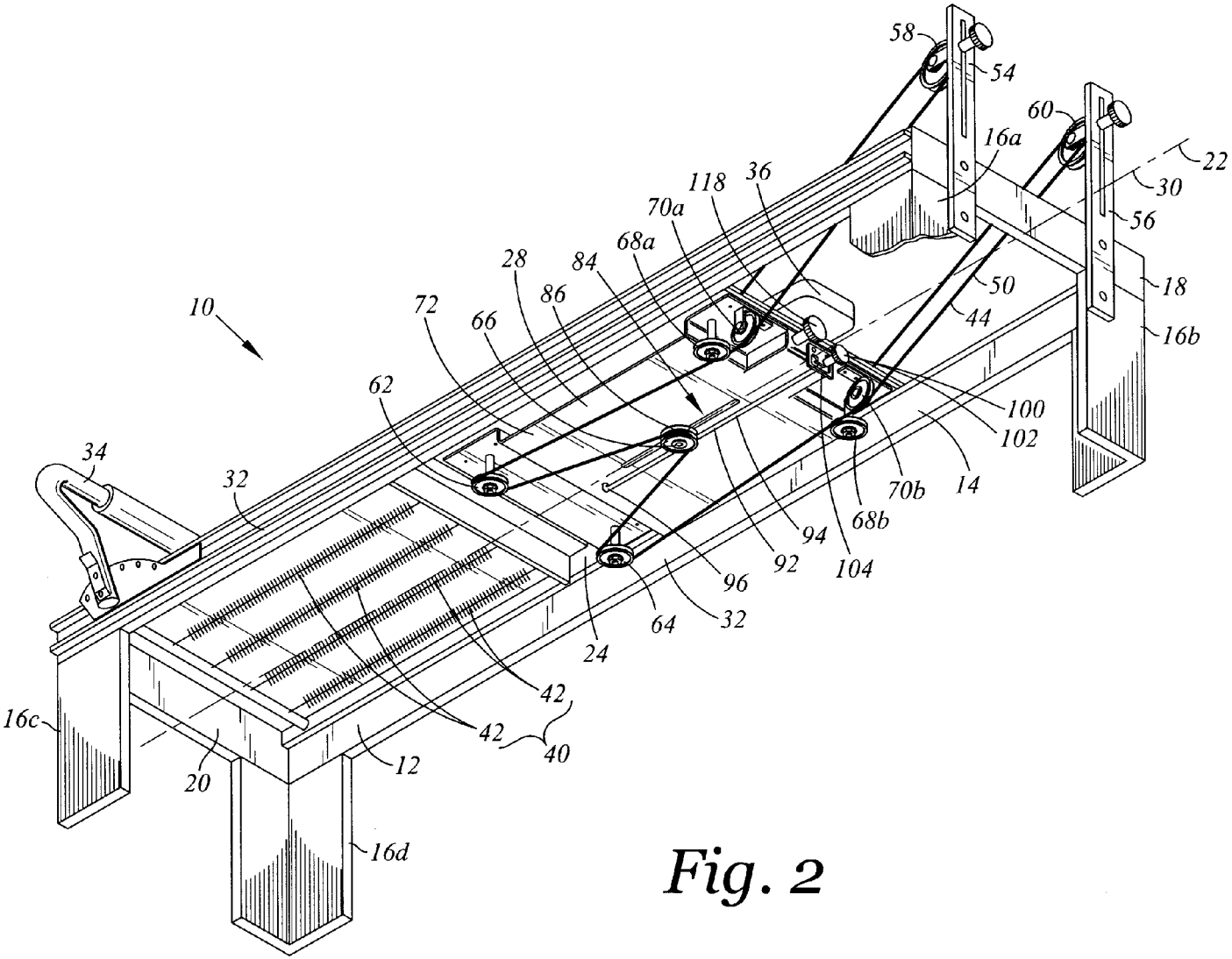
FIG. 2 is a perspective bottom view of the exercise apparatus of FIG. 1 (with a frame leg depicted in cut-away)

Referring now to the drawings wherein the showings are for purposes of illustrating preferred embodiments of the present invention only and not for purposes of limiting the same, FIG. 1 is a perspective top view of an exercise apparatus 10 in accordance with an aspect of the present invention. FIG. 2 is a perspective bottom view of the exercise apparatus of FIG. 1.

The exercise apparatus 10 includes a frame 12 and a carriage 24. In the embodiment depicted, the frame 12 is generally rectangular and includes a frame body 14 which is supported by frame legs 16*a-d* (in FIG. 2, frame leg 16*a* is depicted in cut-away for ease of illustration of other components). The frame 12 includes a frame head end 18 and frame foot end 20, and defines a frame longitudinal axis 22.

According to an aspect of the present invention, the exercise apparatus 10 includes the frame 12, the carriage 24, a central pulley 66, a first frame pulley 58, a second frame pulley 60, a pull cord 44, and a central pulley locking mechanism 92. The carriage 24 is mounted on the frame 12 and movable along the frame longitudinal axis 22. The central pulley 66 is attached to the carriage 24. The first frame pulley 58 is attached to the frame 12 adjacent the frame head end 18. The second frame pulley 60 is attached to the frame 12 adjacent the frame head end 18. The pull cord 44 has first and second handle portions 46, 48. The pull cord 44 is looped about the central pulley 66, the first frame pulley 58 and the second frame pulley 60. The central pulley 66 is between the first and second frame pulleys 58, 60 along the pull cord 44. The first frame pulley 58 is between the first handle portion 46 and the central pulley 66 along the pull cord 44. The second frame pulley 60 is between the second handle portion 48 and the central pulley 66 along the pull cord 44. The central pulley locking mechanism 92 attached to the carriage 24 and configured to engage the central pulley 66 for mitigating movement of the pull cord 44 along the central pulley 66.

In further detail according to various embodiments, the carriage 24 includes a carriage top side 26 and an opposing carriage bottom side 28. The carriage top side 26 may be padded as depicted. The carriage top side 26 is disposed generally facing away from the frame 12, and the carriage bottom side 28 is disposed generally facing towards the frame 12. The carriage 24 defines a carriage longitudinal axis 30 parallel to the frame longitudinal axis 22. The frame 24 may include frame side rails 32. As mentioned above, the carriage 24 is mounted to the frame 12 and movable along the frame longitudinal axis 22. The carriage 24 may be cooperatively formed to slidably engage the frame side rails 32. Though not depicted, the carriage 24 may be provided with wheels, bearings or sliders at the carriage bottom side 28 to facilitate such movability. It is contemplated that various methods for facilitating the mounting of the carriage 24 to the frame 12 may be chosen from any of those which are well known to one of ordinary skill in the art. While the carriage 24 is depicted in a horizontal configuration, it is contemplated that other angulations may be utilized as well.

The frame 24 may include a foot rest 34 at the frame foot end 20. The carriage may include a head pad 36 and a pair of shoulder pads 38 disposed about the head pad 26 upon the carriage top side 26 adjacent the frame head end 18. An exerciser using the exercise apparatus 10 may be positioned laying one his/her back upon the carriage 24 with feet supported by the foot rest 34 and head and shoulders respectively supported by the head pad 26 and shoulder pads 38.

The exercise apparatus 10 may include a resistance member 40. In the particular embodiment depicted, the resistance member 40 takes the form of springs 42. The resistance member 40 may be attached to the carriage 24 at the carriage bottom side 28 and the frame 12 at the frame foot end 20. The resistance member 40 is configured to resist translation of the carriage 24 in a direction away from the frame foot end 20 towards the frame head end 18. It is contemplated that the resistance member 40 may take other forms such as elastic bands and weights using gravity to provide desired resistance levels.

In the embodiment shown, the frame 12 includes first and second pulley supports 54, 56. The first and second frame pulleys 58, 60 are respectively attached to the first and second pulley supports 54, 56. The first and second pulley supports 54, 56 are generally disposed in a vertical configuration. The first and second frame pulleys 58, 60 are adjustably attached to the first and second pulley supports 54, 56 along a length of each of the first and second pulley supports 54, 56. This provides a variety of angulations with respect to the pull cord 44 in relation to the exerciser and may facilitate a variety of exercises.

The carriage 24 may include posts 52*a,b*. The first and second handle portions 46, 48 may be engaged with the posts 52*a,b* as a convenient location to dispose of the first and second handle portions 46, 48 when not in use by the exerciser. The first and second handle portions 46, 48 are generally that portion of the pull cord 44 which an exerciser grasps. In the embodiment depicted, the first and second handle portions 46, 48 take the form of straps. The pull cord 44 includes a pull cord body 50 that extends between the first and second handle portions 46, 48. The pull cord 44 may be formed of any variety of materials and configuration which may be chosen from those which are well known to one of ordinary skill in the art. For example, the pull cord 44 may be formed of fibers which are woven, unwoven, or twisted, and may be of natural or synthetic materials (such as nylon, other plastics, rubber materials, wire, and blends). The pull cord 44 may be a continuous piece of material having material continuity or formed of several segments that are attached or knotted together.

Figure 3:
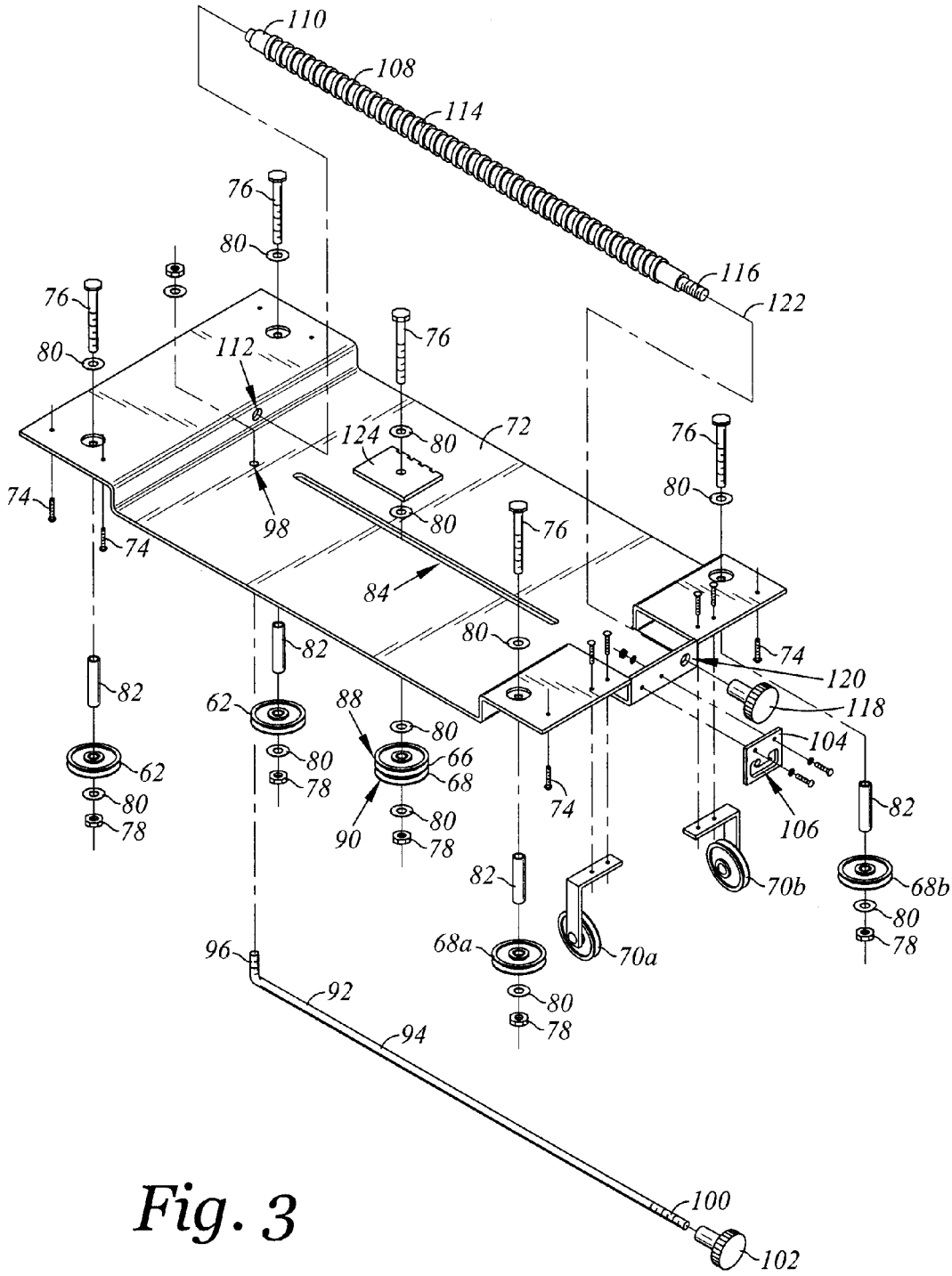
FIG. 3 is a perspective top exploded view of a pulley housing and other components of the exercise apparatus of FIG. 1
Figure 4:
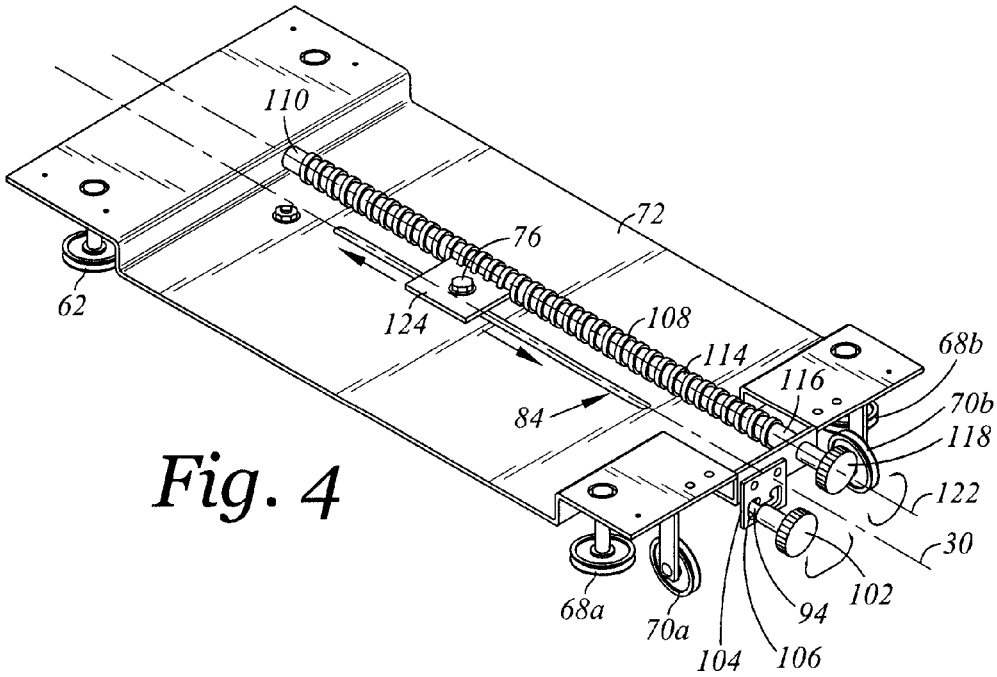
FIG. 4 is the view of FIG. 3 as assembled and illustrating the central pulley locking mechanism in an unlocked position.
Figure 5:
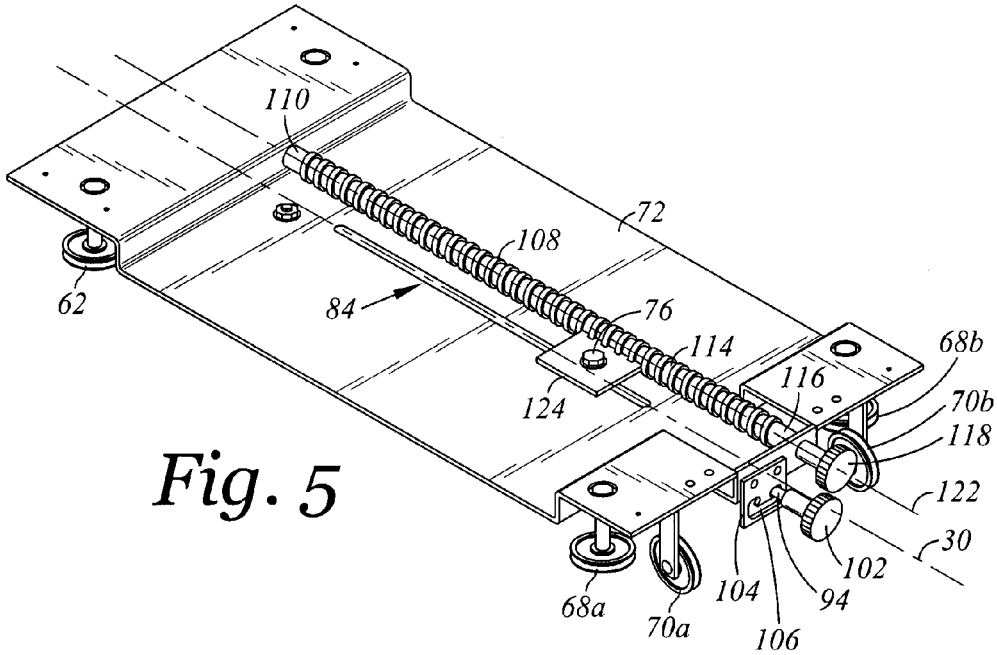
FIG. 5 is the view of FIG. 4, however, with the central pulley locking mechanism in a locked position and the a gear plate translated along a central channel.

Referring now additionally to FIG. 3-5 there is depicted a pulley housing 72. FIG. 3 is a perspective top exploded view of a pulley housing 72 and other components of the exercise apparatus 10 of FIG. 1. FIG. 4 is the view of FIG. 3 as assembled and illustrating the central pulley locking mechanism 92 in an unlocked position. FIG. 5 is the view of FIG. 4, however, with the central pulley locking mechanism 92 in a locked position.

As is depicted in this embodiment, pulley housing 72 is attached to the carriage bottom side 28. A plurality of fasteners 74 may be utilized as well as other well known attachment methods. The pulley housing 72 may take the form of stamped or formed metal sheeting such as depicted. However, it is contemplated that other shapes, configurations, thicknesses, and materials may be chosen from those which are well known to one of ordinary skill in the art. In this embodiment, the central pulley 66 is attached to the frame 12 by the attachment of the central pulley 66 to the pulley housing 72.

The carriage 24 may further include first and second lateral central pulleys 62, 64. The central pulley 66 is disposed between the first and second lateral central pulleys 62, 64 along the pull cord body 50. As mentioned above, the pull cord 44 is looped about the central pulley 66, the first frame pulley 58 and the second frame pulley 60. In the embodiment depicted, the first and second lateral central pulleys 62, 64 are respectively interposed between the central pulley 66 and each of the first and second frame pulleys 58, 60. In this regard, the central pulley 66, the first frame pulley 58 and the second frame pulley 60 need not be consecutively looped by the pull cord 44. The first and second lateral central pulleys 62, 64 need not be utilized, however, such additional intervening pulleys tends to "smoothen out" "jerkiness" in the pull cord system. Additional pulleys may even be utilized.

The carriage 24 may further include horizontal guide wheels 68*a,b* and vertical guide wheels 70*a,b* that are configured to tangentially engage the pull cord body 50. The horizontal guide wheel 68*a* and the vertical guide wheel 70*a* are disposed between the first frame pulley 58 and the central pulley 66 along the pull cord body 50. Similarly, the horizontal guide wheel 68*b* and the vertical guide wheel 70*b* are disposed between the second frame pulley 60 and the central pulley 66 along the pull cord body 50. The horizontal guide wheels 68*a,b* and the vertical guide wheels 70*a,b* facilitate the pull cord body 50 from becoming misaligned with the first and second lateral central pulleys 62, 64.

The central pulley 66, the first and second lateral central pulleys 62, 64, and the horizontal guide wheels 68*a,b* may be attached to the pulley housing 72 with bolts 76, nuts 78, washers 80 and spacers 82. It is contemplated that other methods of attachment may be chosen from those which are well known to one of ordinary skill in the art.

The central pulley 66 may be attached to the carriage 24 adjustably along the carriage longitudinal axis 30. In the embodiment depicted, the central pulley 66 is attached to the pulley housing 72 though a central channel 84 formed through the pulley housing 72. The central pulley 66 includes a central pulley wheel 86 that is configured to rotate about the bolt 76. The central pulley wheel 86 includes a locking bar groove 88 and a pull cord groove 90. The pull cord 66 is engaged with the central pulley 66 with the pull cord body 50 tangentially engaged with the central pulley wheel 86. The pull cord 66 is looped about the central pulley 66 with the pull cord body 50 disposed within the pull cord groove 90. A gear plate 124 is disposed opposite the central pulley 66 with regard to the pulley housing 72. The bolt 76 commonly connects the central pulley 66 and the gear plate 124 through the central channel 84.

A gear 108 is engaged with the pulley housing 72. The pulley housing 72 includes a gear opening 112 and the knob opening 120. The gear 108 has a gear distal end 110, a gear knob end 116 and a gear body 114 extending between the gear distal end 110 and the gear knob end 116. The gear distal end 110 is engaged with the gear opening 112 and the gear knob end 116 is disposed through knob opening 120. A gear knob 118 is engaged with the gear knob end 116. The gear 108 is a worm gear and defines a gear axis of rotation 122. The gear 108 is disposed with the gear axis of rotation 122 parallel to the carriage longitudinal axis 30. The gear plate 124 and the gear 108 are cooperatively formed to engage one another with rotation of the gear 108 about the gear axis of rotation 122 results in translation of the gear plate 124 in a direction parallel to the gear axis of rotation 122. In so doing, the attached central pulley 66 may be adjusted in its attached location with regard to the carriage longitudinal axis 30. As such, the gear 108 facilitates a convenient method of an exerciser to adjust the positioning of the carriage 24 in relation the frame 12 and the available lengths of the pull cord 44 as extending between the first and second handle portions 46, 48 and the first and second frame pulleys 58, 60. It is contemplated that other methods of adjustably attaching the central pulley 66 to the carriage 24 may be utilized such as through the use of fasteners or lock pins for examples.

As mentioned above, the exercise apparatus 10 includes a central pulley locking mechanism 92. In the embodiment depicted, the central pulley locking mechanism 92 includes a locking bar 94 with a pivot end 96 and a distal end 100. The pulley housing 72 includes a locking bar pivot end opening 98. The pivot end 96 is engaged with the locking bar pivot end opening 98. A guide plate 104 is attached to the pulley housing 72. The guide plate 104 includes a guide slot 106 in the form of a U-shape. The distal end 100 is disposed through the guide slot 106. A knob 102 is attached to the distal end 100 to attach the locking bar 94 to the pulley housing 72. FIG. 4 depicts the central pulley locking mechanism 92 in an unlocked position with the locking bar 94 positioned at a leftmost portion of the guide slot 106. The locking bar 94 is pivoted away from the central pulley 66. FIG. 5 depicts the central pulley locking mechanism 92 in a locked position with the locking bar 94 positioned at a rightmost portion of the guide slot 106. The locking bar 94 is pivoted towards the central pulley 66 with the locking bar 94 engaging the locking bar groove 88. Such engagement is contemplated to resist rotation of the central pulley wheel 86 to "lock" the central pulley 66.

The central pulley locking mechanism 92 may be of other configurations. For example, in another embodiment, a lock pin may be used to engage the central pulley wheel 86 to prevent or otherwise mitigation rotation of the central pulley wheel 86 and thereby resist movement of the pull cord body 50 along the central pulley 66. In another embodiment of the central pulley locking mechanism 92 may directly contact the pull cord body 50 by pinching the pull cord body against the central pulley 66.

As used herein the term "pulley" refers to a component used with the exercise apparatus 10 that interfaces with the pull cord 44 to provide a mechanical advantage with the pull cord 44 imparting force upon the pulley. The pulley may be rotational in nature with a wheel rotating about an axis of rotation. The wheel may include a hub or pin (or fasteners such as the bolts 74). In addition, bearings may be utilized to facilitate rotation. The pulley may be non-rotational in nature with the pull cord 44 in slidable contact with the pulley. Moreover, the components comprising the pulley may be incorporated or integrated with other components of the exercise apparatus 10.

As used herein the terms "along the pull cord 44" refers to a pulley being looped by the pull cord 44 relative in longitudinal position to other pulleys being looped by the pull cord 44.

Referring now to FIGS. 6-11 there are depicted top symbolic views to facilitate a discussion of some of the relative movements of the carriage 24 and the pull cord 44. In addition, there are depicted the first and second frame pulleys 58, 60, the first and second lateral central pulleys 62, 64, the central pulley 66, the horizontal guide wheels 68*a,b*, and the vertical guide wheels 70*a,c*.

Figure 6:
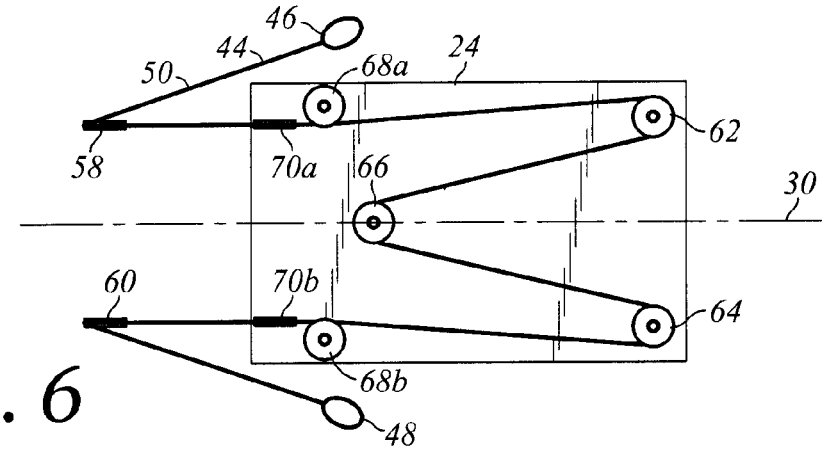
FIG. 6 is a top symbolic view of a carriage, pulleys and a pull cord having first and second handle portions.

FIG. 6 is a top symbolic view of the carriage 24 and the pull cord 44 having with the first and second handle portions 46, 48 in a sample starting position. For example, an exerciser may be grasping the first and second handle portions 46, 48 while lying upon the carriage 24 with the exerciser's back against the carriage top side 26.

The position of the central pulley 66 may be adjusted along the carriage longitudinal axis 30 this may be to facilitate various sizes of different exercisers and/or types of exercises to be performed. For example, referring now to FIG. 7, the position of the central pulley 66 is moved to the right along the carriage longitudinal axis 30. As a consequence, the carriage 24 also moves to the right (for reference the carriage starting position as depicted in FIG. 6 is denoted in dashed line carriage 24'). It is noted that in this FIG. 7, the relative positioning of the first and second handle portions 46, 48 are the same as in FIG. 6. It is understood that the central pulley 66 may be adjusted in its attachment location along the carriage longitudinal axis 30 so as to facilitate an effective lengthening of the segments of the pull cord body 30 between the first and second handle portions 46, 48 respectively to the first and second frame pulleys 58, 60.

Figure 8:
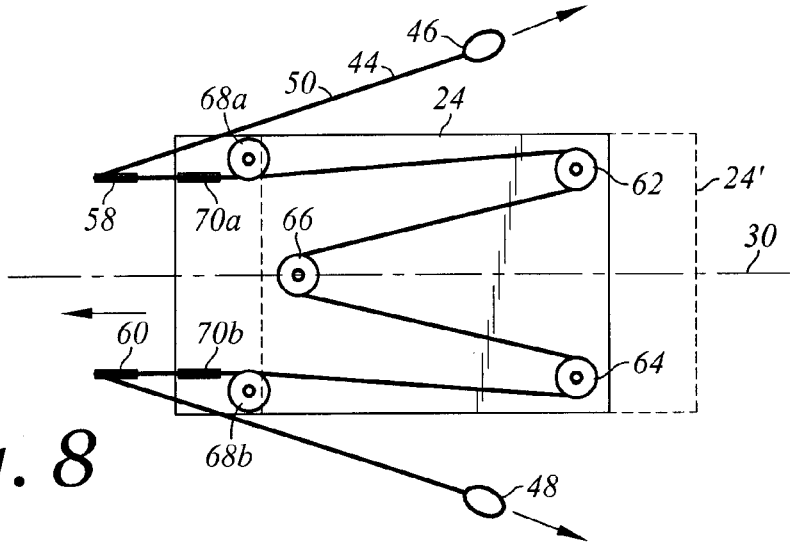
FIG. 8 is the view of FIG. 6, however, with the carriage translated to the left and the first and second handle portions extended to the right.
Figure 9:
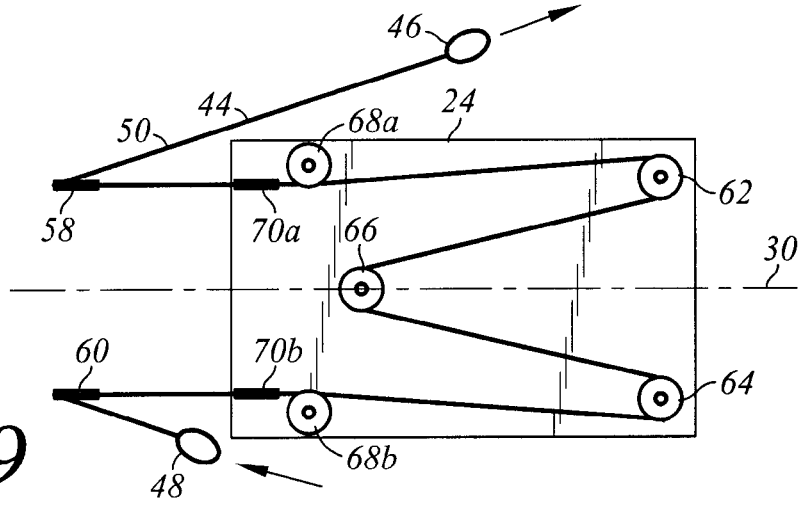
FIG. 9 is the view of FIG. 6, however, with the first handle portion extended to the right and the second handle portion translated to the left.

Referring now to FIG. 8, there is depicted the view of FIG. 6, however, with the carriage 24 translated to the left and the first and second handle portions 46, 48 extended to the right. This is an example the exerciser having equally pulled the first and second handle portions 46, 48. The movement of the carriage 24 is resisted by the resistance member 40.

Figure 7:
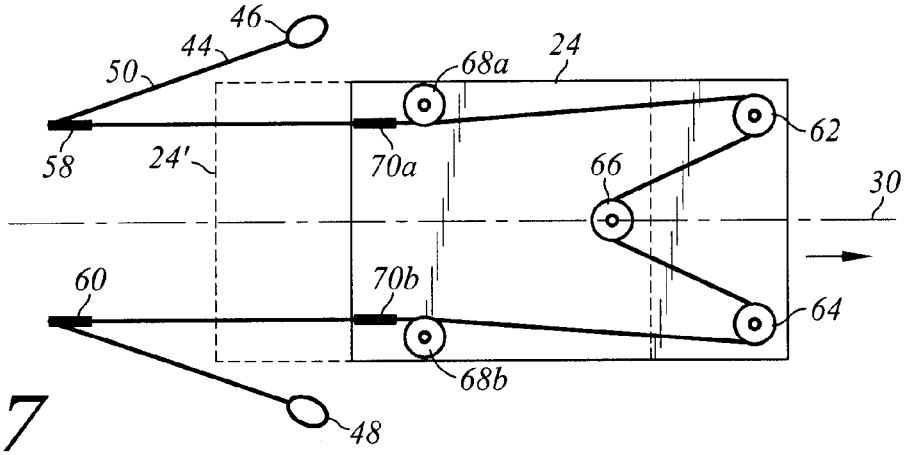
FIG. 7 is the view of FIG. 6, however, with the carriage translated to the right and a central pulley translated to the right along the carriage.

The exercise apparatus 10 may be used with the central locking mechanism 92 in either a locked or an unlocked position. In the locked position, the exemplary transition between the states of the exercise apparatus 10 of FIG. 6 to FIG. 8 illustrates how the exercise apparatus 10 facilitates a movement or exercise that may be performed on a traditional reformer type exercise apparatus. In this regard, the exerciser may pull with an unequal exertion on the first and second handle portions 46, 48 and the carriage 24 is still moved as a result. For example, a user may pull with only the exerciser's left arm and the carriage 24 would still move. While the pull cord body 50 would be disposed in tension along those segments between the central pulley 66 and the first handle portion 46, those segments of the pull cord body 50 between the central pulley 66 and the second handle portion 48 would become slack (or have less tension).

Advantageously, the exerciser may initially place the central locking mechanism 92 in an unlocked position so as to adjust or equalize the segments length between the first and second frame pulleys 58, 60 in relation to the first and second handle portions 46, 48. In this regard, while the exercise apparatus 10 may be subsequently used with the central locking mechanism 92 in a locked position, this allows for an efficient relative length adjustment of the first and second handle portions 46, 48 in comparison to a traditional reformer type exercise apparatus. This is because a traditional reformer type exercise apparatus has two independent pull cords with each pull cord having to be adjusted in length relative to each other. This may entail an awkward and time consuming fastening/unfastening process. The central locking mechanism 92 allows for an adjustment with a simple movement, such as by moving the locking bar 94 along the guide slot (though it is understood that a locking bar is not required as other configurations of the central locking mechanism 92 are contemplated).

However, as mentioned above, the central locking mechanism 92 advantageously allows the exercise apparatus 10 to be used to perform exercises with the central locking mechanism 92 in an unlocked position. In the unlocked position, the exemplary transition between the states of the exercise apparatus 10 of FIG. 6 to FIG. 8 also illustrates how the exercise apparatus 10 facilitates a movement or exercise that is not feasible of being performed on a traditional reformer type exercise apparatus. The amount of exertion between limbs may be considered relatively independent.

With the central locking mechanism 94 in the unlocked position, the equal movement of the first and second handle portions 46, 48 against the resistance of the resistance member 40 when affecting a movement of the carriage 24 requires proprioceptive or coordinated movements of the exerciser. Allowing the exerciser to perform proprioceptive movements adds significant versatility to the types of exercises that may be conducted with the exercise apparatus 10. Thus, the exerciser must equally exert force upon each of the first and second handle portions 46, 48 in order to move the carriage 24 and have the both of the first and second handle portions move in unison. This arrangement provides an immediate feedback to the exerciser because an unequal exertion would result in an unequal positioning of the first and second handle portions 46, 48. The exerciser may use the exercise apparatus 10 to perform exercises with the exertion of the exerciser's limbs being dependent upon each other.

Figure 10:
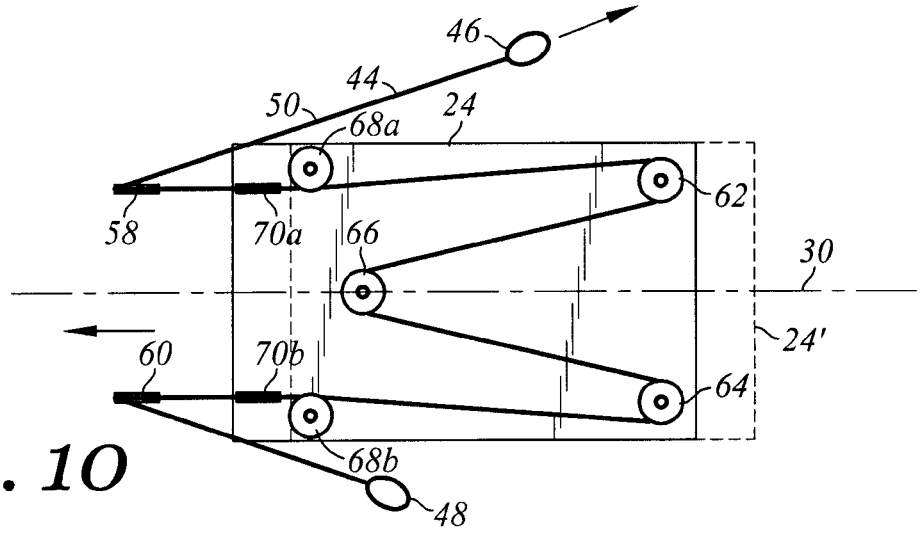
FIG. 10 is the view of FIG. 6, however, with the carriage translated to the left, the first handle portion extended to the right and the second handle portion translated to the right in an unequal amount of extension.

Referring to FIG. 10, there is depicted the first handle portion 46 extended to the right and the second handle portion 48 translated to the left. This may be a result of the exerciser exerting a significant imbalance of force between the exerciser's limbs. The carriage 24 is in the same position as that of FIG. 6. Thus, the exerciser may use the exercise apparatus 10 to perform repetitive opposite movements alternating between limbs.

Referring to FIG. 10, there is depicted the view of FIG. 6, however, with the carriage 24 translated to the left, the first handle portion 46 extended to the right and the second handle portion 48 also translated to the right with an unequal amount of extension. The central locking mechanism 92 is in the unlocked position. This illustrates an exercise that allows the exerciser to focus or isolate upon a single limb while also activating or exerting muscles of the other limb and core of the exerciser. In this exercise, exertion is used by both limbs to move the carriage 24 to the left. Next, the exerciser attempts to generally maintain the relative position of the second handle portion 48. At the same instance, the exerciser pulls the first handle portion 46 to extend the pull cord body 50 away from the first frame pulley 58 in a repetitive movement (such as curls or arm lifts).

Figure 11:
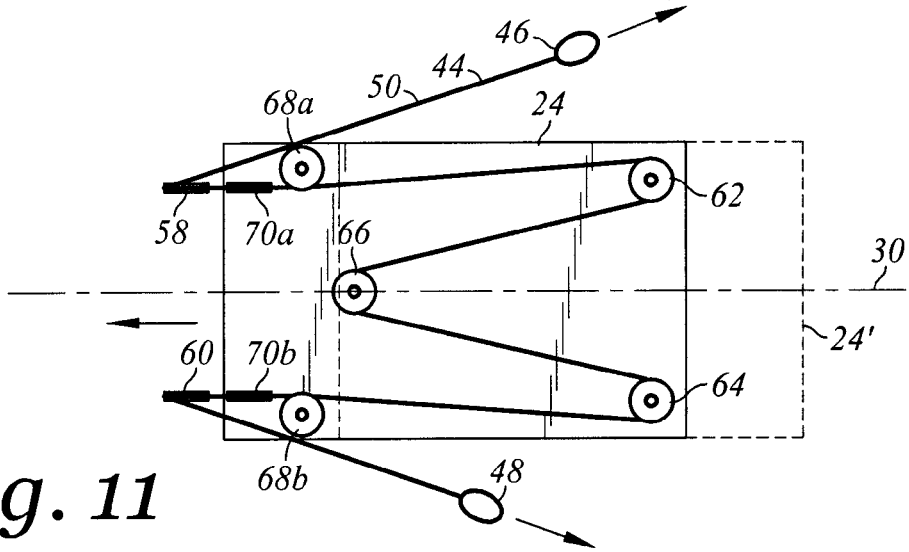
FIG. 11 is the view of FIG. 10, however, with the carriage translated to the left and the first handle portion further extended to the right.

Referring to FIG. 11, there is depicted the view of FIG. 6, however, with the carriage 24 translated to the left, the first handle portion 46 extended to the right and the second handle portion 48 also translated to the right with an unequal amount of extension. The central locking mechanism 92 is in the unlocked position. This illustrates an example where the exerciser may be attempting unsuccessfully to equally pull upon the first and second handle portions 46, 48. As such, the exerciser is provided feedback of such unequal exertion because it is readily apparent that the positioning of the first and second handle portions 46, 48 are not the same.

It is understood that FIG. 6-11 only illustrate a selected few example of the variety of exercises that may be performed using the exercise apparatus 10. For example, the exerciser need not be lying upon the exerciser's back. Moreover, the exerciser need not grasp the first and second handle portions 46, 48 with both hands. Rather, a combination of hands and/or feet may be used as well.

In addition, according to another aspect of the present invention, there is provided a retrofit kit that may be used with an existing exercise apparatus, such as a traditional reformer type exercise apparatus. In this regard, the retrofit kit that includes at least the pulley housing 72, the central pulley 66, the central pulley locking mechanism 92 and the pull cord 44.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An exercise apparatus comprising:

a frame having a frame head end and an opposing frame foot end, the frame defining a frame longitudinal axis;

a carriage mounted on the frame and movable along the frame longitudinal axis, the carriage defining a carriage longitudinal axis parallel to the frame longitudinal axis;

a central pulley attached to the carriage, the central pulley being attached to the carriage adjustably along the carriage longitudinal axis;

a first frame pulley attached to the frame adjacent the frame head end;

a second frame pulley attached to the frame adjacent the frame head end;

a pull cord having first and second handle portions, the pull cord being looped about the central pulley, the first frame pulley and the second frame pulley, the central pulley being between the first and second frame pulleys along the pull cord, the first frame pulley being between the first handle portion and the central pulley along the pull cord, the second frame pulley being between the second handle portion and the central pulley along the pull cord;

a central pulley locking mechanism attached to the carriage and configured to engage the central pulley for mitigating movement of the pull cord along the central pulley; and an adjustment element engaged with the central pulley, the adjustment element being sized and configured to translate the central pulley along the carriage longitudinal axis.

2. The exercise apparatus of claim 1 wherein the central pulley locking mechanism includes a locking bar, the locking bar having a locked position with the locking bar engaged with the central pulley, the locking bar having an unlocked position with the locking bar not engaged with the central pulley.

3. The exercise apparatus of claim 2 wherein the central pulley includes a central pulley wheel and the locking bar tangentially engages the central pulley wheel.

4. The exercise apparatus of claim 1 wherein the central pulley includes a central pulley wheel with the pull cord being looped about the central pulley wheel, the central pulley locking mechanism is configured to mitigate rotation of the central pulley wheel.

5. The exercise apparatus of claim 1 wherein the frame further includes first and second pulley supports extending from the frame, the first frame pulley is attached to the first pulley support, the second frame pulley is attached to the second pulley support.

6. The exercise apparatus of claim 1 wherein the carriage includes a carriage top side and an opposing carriage bottom side, the carriage top side is disposed generally facing away from the frame, the carriage bottom side is disposed generally facing towards the frame, the central pulley is attached to the carriage at the carriage bottom side.

7. The exercise apparatus of claim 1 wherein the central pulley includes a pulley pin and a pulley wheel disposed about the pulley pin, the pull cord is looped about the pulley wheel, the pulley pin is attached to the carriage adjustably along the carriage longitudinal axis.

8. The exercise apparatus of claim 1 wherein the adjustment element includes a gear engaged with the central pulley, rotation of the gear translates the central pulley along the carriage longitudinal axis.

9. The exercise apparatus of claim 1 wherein the carriage defines a carriage longitudinal axis parallel to the frame longitudinal axis, the exercise apparatus further comprises first and second lateral central pulleys laterally disposed about the central pulley with respect to the carriage longitudinal axis.

10. The exercise apparatus of claim 9 wherein the pull cord is looped about the first and second lateral central pulleys, the central pulley is between the first and second lateral central pulleys along the pull cord, the first lateral central pulley is between the first frame pulley and the central pulley along the pull cord, the second lateral central pulley is between the second frame pulley and the central pulley along the pull cord.

11. The exercise apparatus of claim 1 further comprises first and second guide wheels attached to the carriage, the pull cord is tangentially engaged with the first guide wheel with the first guide wheel being between the central pulley and the first frame pulley, the pull cord is tangentially engaged with the second guide wheel with the second guide wheel being between the central pulley and the second frame pulley.

12. The exercise apparatus of claim 1 wherein the frame defines a frame horizontal plane that includes the frame longitudinal axis, the first and second frame pulleys are disposed along an axis parallel to the frame horizontal plane.

13. The exercise apparatus of claim 1 further includes a resistance member attached to the carriage foot end, the resistance member configured to resist movement of the carriage along the frame longitudinal axis in a direction away from the frame foot end.

14. A retrofit kit for use with an exercise apparatus, the exercise apparatus including a frame, a carriage, and first and second frame pulleys, the frame having a frame head end and an opposing frame foot end, the frame defining a frame longitudinal axis, the carriage mounted on the frame and movable along the frame longitudinal axis, the second frame pulley attached to the frame adjacent the frame head end, the retrofit kit comprising:

a pulley housing attachable to the carriage;

a central pulley attached to the pulley housing;

a pull cord having first and second handle portions, the pull cord being sized to be looped about the central pulley, the first frame pulley and the second frame pulley, the central pulley being positionable between the first and second frame pulleys along the pull cord, the central pulley being positionable with the first frame pulley being between the first handle portion and the central pulley along the pull cord, the central pulley being positionable with the second frame pulley being between the second handle portion and the central pulley along the pull cord;

a central pulley locking mechanism attached to the housing and configured to engage the central pulley for mitigating movement of the pull cord along the central pulley;

an adjustment element engagable with the central pulley, the carriage defining a carriage longitudinal axis parallel to the frame longitudinal axis and the central pulley being attached to the carriage adjustably along the carriage longitudinal axis the adjustment element being sized and configured to translate the central pulley along the carriage longitudinal axis with the adjustment element being engaged with the central pulley.

15. The retrofit kit of claim 14 wherein the central pulley locking mechanism includes a locking bar, the locking bar having a locked position with the locking bar engaged with the central pulley, the locking bar having an unlocked position with the locking bar not engaged with the central pulley.

16. The retrofit kit of claim 15 wherein the central pulley includes a central pulley wheel and the locking bar tangentially engages the central pulley wheel.

17. The retrofit kit of claim 14 wherein the central pulley includes a central pulley wheel with the pull cord being looped about the central pulley wheel, the central pulley locking mechanism is configured to mitigate rotation of the central pulley wheel.

18. The retrofit kit of claim 14 wherein the central pulley includes a pulley pin and a pulley wheel disposed about the pulley pin, the pull cord is looped about the pulley wheel, and the pulley pin is attached to the carriage adjustably along the carriage longitudinal axis.

19. The retrofit kit of claim 14 wherein the adjustment element includes a gear engaged with the central pulley, rotation of the gear translates the central pulley along the carriage longitudinal axis.

* * * * *

UNITED STATES PATENT AND TRADEMARK OFFICE

CERTIFICATE OF CORRECTION

PATENT NO. : 8,663,074 B2
APPLICATION NO. : 12/719396
DATED : March 4, 2014
INVENTOR(S) : Uygan It is certified that error appears in the above-identified patent and that said Letters Patent is hereby corrected as shown below:

On the Title Page, Item (74), under "Attorney, Agent or Firm", in Column 2, Line 1, delete "Greenberg Travrig, LLP" and insert -- Greenberg Traurig, LLP --, therefor.

Signed and Sealed this
Fifth Day of August, 2014

Michelle K. Lee

Michelle K. Lee
*Deputy Director of the United States Patent and Trademark Office*